US008327772B2

(12) United States Patent
Oku et al.

(10) Patent No.: US 8,327,772 B2
(45) Date of Patent: Dec. 11, 2012

(54) LOW-FLOOR RAILWAY VEHICLE BOGIE AND LOW-FLOOR RAILWAY VEHICLE COMPRISING THE BOGIE

(75) Inventors: Yasumasa Oku, Kobe (JP); Shinya Matsuki, Akashi (JP); Masaru Tachibana, Akashi (JP); Yoshinori Seki, Kobe (JP); Noboru Kobayashi, Kobe (JP)

(73) Assignee: Kawasaki Jukogyo Kabushiki Kaisha, Kobe-Shi (JP)

( * ) Notice: Subject to any disclaimer, the term of this patent is extended or adjusted under 35 U.S.C. 154(b) by 221 days.

(21) Appl. No.: 12/734,662

(22) PCT Filed: Nov. 16, 2007

(86) PCT No.: PCT/JP2007/072301

§ 371 (c)(1),
(2), (4) Date: Jul. 6, 2010

(87) PCT Pub. No.: WO2009/063569

PCT Pub. Date: May 22, 2009

(65) Prior Publication Data

US 2010/0294164 A1 Nov. 25, 2010

(51) Int. Cl.
*B61F 3/00* (2006.01)

(52) U.S. Cl. ..... 105/182.1; 105/183; 105/185; 105/72.2; 105/215.1

(58) Field of Classification Search ..... 105/182.1, 105/158.2, 185, 215.1, 215.2
See application file for complete search history.

(56) References Cited

U.S. PATENT DOCUMENTS 2,016,626 A * 10/1935 Constantinesco ..... 105/72.2
2,030,311 A * 2/1936 Messick ..... 105/215.2
2,039,489 A * 5/1936 Messick ..... 105/215.2
2,140,421 A * 12/1938 Fageol ..... 105/72.2
2,986,102 A * 5/1961 Cox ..... 105/72.2
(Continued)

FOREIGN PATENT DOCUMENTS

DE 43 22 760 A1 1/1995
(Continued)

OTHER PUBLICATIONS

Extended European Search Report issued in Application No. 07832031.4 dated Jun. 24, 2011.
(Continued)

*Primary Examiner* — Jason C Smith
(74) *Attorney, Agent, or Firm* — Oliff & Berridge, PLC

(57) ABSTRACT

A bogie for a low floor type railway vehicle, in which the accuracy of the distance between left and right wheels is enhanced and which enables a vehicle body to be low-floored. The bogie has a bogie frame for supporting the body of the railway vehicle, a main axle and an auxiliary axle arranged so as to laterally extend at the front and rear in the traveling direction of the bogie frame, wheels attached to both the left and right sides of each of the axles, shaft boxes attached to both the left and right sides of each of the axles and supporting the axle, and shaft box support devices respectively supporting each of the shaft boxes by elastically joining the shaft boxes and the bogie frame together. The wheels attached to the main axle are large-diameter wheels, and the wheels attached to the auxiliary axle are small-diameter wheels having a smaller diameter than the large-diameter wheels.

9 Claims, 16 Drawing Sheets

U.S. PATENT DOCUMENTS

| | | | | | |
|---|---|---|---|---|---|
| 3,333,551 | A | * | 8/1967 | Pelz et al. | 105/183 |
| 3,645,211 | A | * | 2/1972 | Gretzschel et al. | 105/72.2 |
| 3,653,332 | A | * | 4/1972 | Olson et al. | 105/72.2 |
| 3,665,865 | A | * | 5/1972 | Pelz | 105/183 |
| 3,732,828 | A | * | 5/1973 | Wanner | 104/33 |
| 3,763,789 | A | * | 10/1973 | Olson et al. | 105/72.2 |
| 3,980,025 | A | * | 9/1976 | Olson et al. | 105/72.2 |
| 4,232,611 | A | * | 11/1980 | Uozumi | 105/215.1 |
| 4,459,919 | A | * | 7/1984 | Lemaire et al. | 105/169 |
| 4,537,137 | A | * | 8/1985 | White, Jr. | 105/72.2 |
| 4,579,064 | A | * | 4/1986 | Cawley | 105/215.1 |
| 5,042,394 | A | * | 8/1991 | De Ro et al. | 105/168 |
| 5,086,706 | A | * | 2/1992 | Boivin | 105/168 |
| 5,107,773 | A | * | 4/1992 | Daley et al. | 105/185 |
| 5,211,116 | A | * | 5/1993 | Schneider | 105/168 |
| 5,372,073 | A | * | 12/1994 | Cattani | 105/3 |
| 5,448,953 | A | * | 9/1995 | Bieker et al. | 105/158.2 |
| 5,586,507 | A | * | 12/1996 | Madison et al. | 105/215.2 |
| 5,619,931 | A | * | 4/1997 | Madison | 105/72.2 |
| 5,868,078 | A | * | 2/1999 | Madison | 105/72.2 |
| 6,601,520 | B2 | * | 8/2003 | Eche et al. | 105/34.1 |
| 2001/0051746 | A1 | * | 12/2001 | Hagihara et al. | 562/400 |
| 2002/0195018 | A1 | * | 12/2002 | Eche et al. | 105/158.2 |
| 2010/0294164 | A1 | * | 11/2010 | Oku et al. | 105/182.1 |
| 2011/0239899 | A1 | * | 10/2011 | Okubo et al. | 105/185 |
| 2012/0060719 | A1 | * | 3/2012 | Nishimura et al. | 105/182.1 |

FOREIGN PATENT DOCUMENTS

| | | | | |
|---|---|---|---|---|
| EP | 0 348 378 | B1 | | 9/1991 |
| FR | 454 940 | | | 7/1913 |
| FR | 2 572 348 | | | 5/1986 |
| GB | 05210 | | | 0/1913 |
| JP | A-2001-158346 | | | 6/2001 |
| JP | A-2001-301614 | | | 10/2001 |
| JP | A-2002-264809 | | | 9/2002 |
| JP | A-2003-226234 | | | 8/2003 |
| JP | A-2004-276730 | | | 10/2004 |
| JP | A-2007-331461 | | | 12/2007 |
| JP | A-2007-331713 | | | 12/2007 |
| JP | 2008132828 | A | * | 6/2008 |

OTHER PUBLICATIONS

International Search Report issued in International Application No. PCT/JP2007/072301 on Feb. 26, 2008 (with translation).

* cited by examiner

LOW-FLOOR RAILWAY VEHICLE BOGIE AND LOW-FLOOR RAILWAY VEHICLE COMPRISING THE BOGIE

TECHNICAL FIELD

The present invention relates to a low-floor railway vehicle bogie for supporting a car body having a boarding space and a low-floor railway vehicle comprising the bogie.

BACKGROUND ART

Bogies are respectively mounted under a floor of a car body of a railway vehicle such as a light rail vehicle and drive along rails while supporting the car body. A general bogie has a construction in which a pair of axles are rotatably attached to front and rear sides of a bogie frame and a pair of wheels are mounted to each axle. Various devices such as air springs for absorbing a vibration of the car body and a motor for rotating the axles are mounted to the bogie frame.

In the vehicle including the bogies described above, since the car body on which passengers get is provided on the bogies, the floor surface of the car body is provided at a position that is distant from the ground, thereby generating a difference in height between an entrance of the car body and the ground. Accordingly, in recent years, to achieve barrier-free purposes, a low-floor railway vehicle appears, which is provided with an entrance at a lower position to enable elderly persons, handicapped persons, and others to easily get on and out of the car body.

For example, in a bogie disclosed in EP Patent Publication No. 348378, an axle for coupling right and left wheels is omitted, and wheels are directly rotatably attached to a bogie frame. In addition, one of two pairs of wheels have a larger diameter and the remaining pair of wheels have a smaller diameter. In this construction, the floor surface of the car body which is located above the small-diameter wheels can be made lower, and there can be formed a space in which components and members are disposed between the large-diameter wheels.

DISCLOSURE OF THE INVENTION

Problem to be Solved by the Invention

However, the bogie in the above publication includes a number of link mechanisms to enable the right and left wheels which are rotatable independently to easily pass through a curve, making its structure very complex. In railway vehicles, since a distance between right and left rails of a railway track is constant, accuracy is required in a distance between the right and left wheels. If a complex mechanism intervenes between the right and left wheels, accuracy of the distance between the wheels would decrease in the case of independent wheels without axles.

Accordingly, an object of the present invention is to provide a low-floor car body while improving accuracy of a distance between right and left wheels.

Means for Solving the Problems

The present invention has been made in view of the circumstances, and low-floor railway vehicle bogie of the present invention comprises a bogie frame configured to support a car body of a railway vehicle; a main axle and a sub-axle which are disposed at front and rear sides of the bogie frame in a driving direction, respectively such that the main axle and the sub-axle extend in a rightward and leftward direction; wheels attached to right and left sides of each of the main axle and the sub-axle; axle boxes which are respectively mounted to right and left sides of each of the main axle and the sub-axle and are configured to support the axle; and axle box suspensions which are configured to elastically couple the axle boxes to the bogie frame to support the axle boxes, respectively; wherein the wheels attached to the main axle are large-diameter wheels and the wheels attached to the sub-axle are small-diameter wheels which have a smaller outer diameter than the large-diameter wheels.

In accordance with such a configuration, since the large-diameter wheels are arranged at one of front and rear sides in the driving direction, and the small-diameter wheels are arranged at the other side, the large-diameter wheels can maintain driving stability and the floor surface of the car body positioned above the small-diameter wheels can be made lower. In addition, since the small-diameter wheels are coupled to each other by the sub-axle extending in the rightward and leftward direction, the distance between the right and left small-diameter wheels can be maintained accurately to be equal to the distance between the rails, and driving stability can be improved.

A low-floor railway vehicle of the present invention comprises a car body; and a bogie coupled to the car body, the bogie including: a bogie frame; a main axle extending in a rightward and leftward direction and positioned closer to an end portion of the car body in a driving direction; a sub-axle extending in the rightward and leftward direction and positioned closer to a center of the car body than the main axle in the driving direction; large-diameter wheels which are attached to right and left sides of the main axle; small-diameter wheels which are attached to right and left sides of the sub-axle and have a smaller outer diameter than the large-diameter wheels; axle boxes which are mounted to right and left sides of each of the main axle and the sub-axle and are configured to support the axle; and axle box suspensions which are configured to elastically couple the axle boxes to the bogie frame to support the axle boxes, respectively; wherein the car body includes: a driver cabin which is positioned closer to the end portion of the car body in the driving direction and above the large-diameter wheels; and a passenger cabin which is positioned closer to the center of the car body than the driver cabin and above the small-diameter wheels, the passenger cabin having a floor surface lower than a floor surface of the driver cabin.

In accordance with such a configuration, since the large-diameter wheels are positioned closer to the end portion of the car body in the driving direction and the small-diameter wheels are positioned closer to the center of the car body in the driving direction, in the bogie positioned at the end portion of the car body in the driving direction, the large-diameter wheels can maintain driving stability and the floor surface of the car body can be made lower in a range from the center region of the car body to a region above the small-diameter wheels. In addition, since the small-diameter wheels are coupled to each other by the sub-axle extending in the rightward and leftward direction, the distance between the right and left small-diameter wheels can be maintained accurately to be equal to the distance between the rails, and driving stability can be improved.

BEST MODE FOR CARRYING OUT THE INVENTION

Hereinafter, embodiments of the present invention will be described with reference to Figures.

(Embodiment 1)

Figure 1:
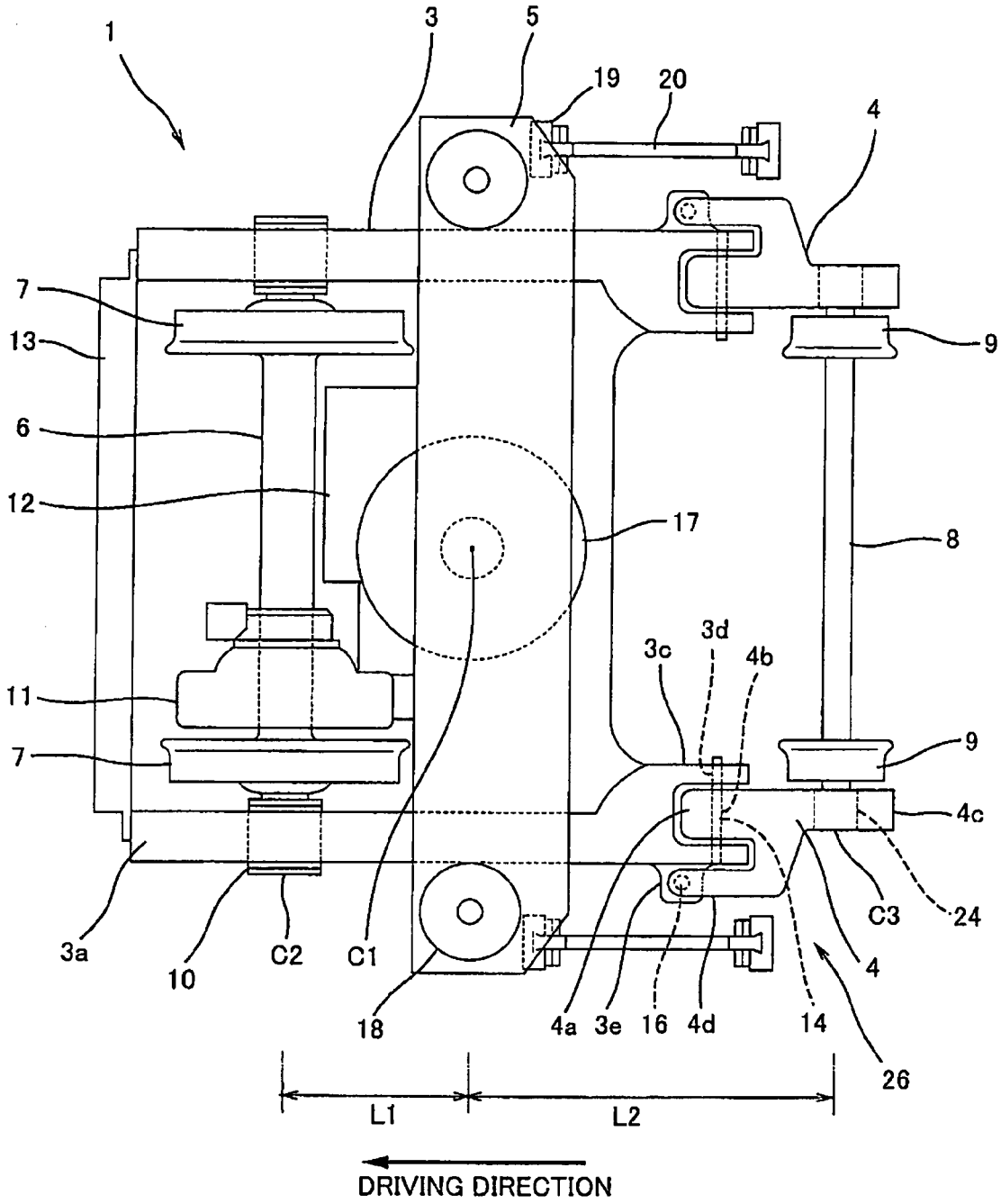
FIG. 1 is a plan view of a low-floor railway vehicle bogie according to Embodiment 1 of the present invention.
Figure 2:
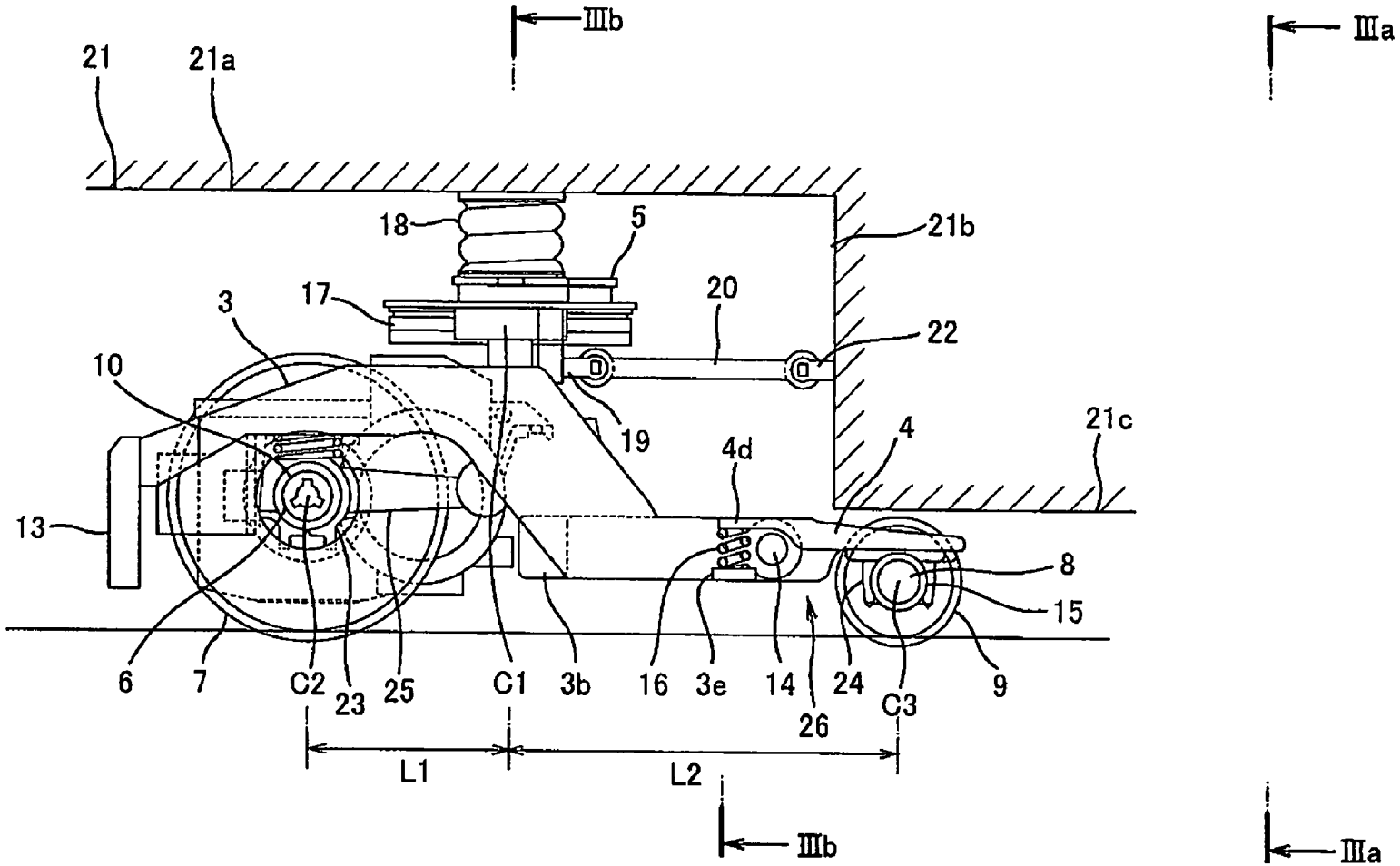
FIG. 2 is a side view of the bogie of FIG. 1.
Figure 3:
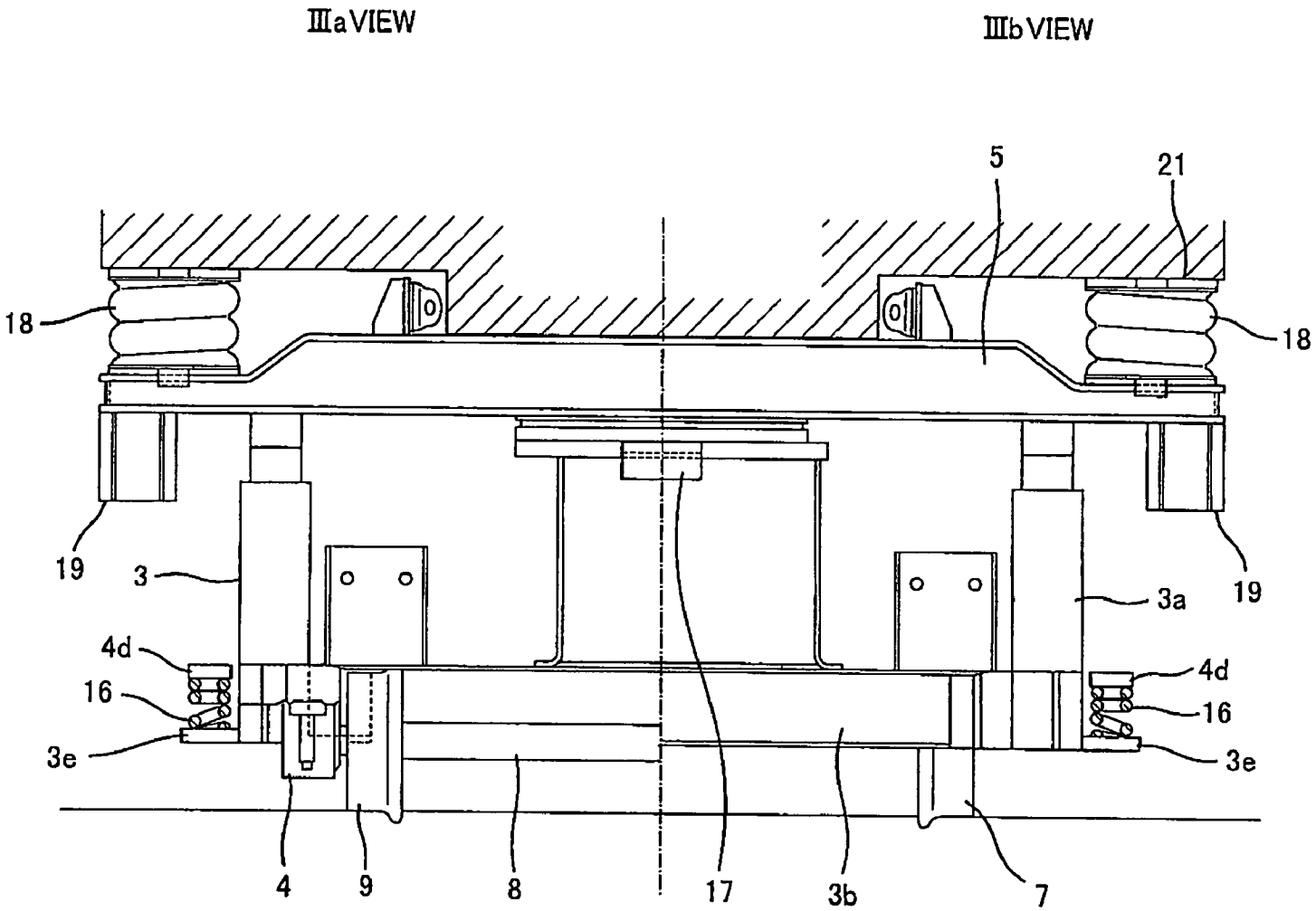
FIG. 3 is a rear view showing a left-half part taken in the direction of IIIa of FIG. 2 and a right-half part taken in the direction of IIIb of FIG. 2.

FIG. 1 is a plan view of a low-floor railway vehicle bogie 1 according to Embodiment 1 of the present invention. FIG. 2 is a side view of the bogie 1 of FIG. 1. FIG. 3 is a rear view showing a left-half part taken in the direction of IIIa of FIG. 2 and a right-half part taken in the direction of IIIb of FIG. 2. It should be noted that in FIG. 1, leftward indicates forward in a driving direction, rightward indicates rearward in the driving direction, an upper side indicates a right side and a lower side indicates a left side. As shown in FIGS. 1 to 3, the bogie 1 of this embodiment includes a bogie frame 3 for supporting a car body 21. A main axle 6 and a sub-axle 8 are rotatably attached to front and rear sides of the bogie frame 3. A pair of large-diameter wheels 7 are attached to the right and left portions of the main axle 6, respectively, while a pair of small-diameter wheels 9 are attached to right and left sides of the sub-axle 8, respectively.

The bogie frame 3 is substantially H-shaped as viewed from above, and includes a pair of right and left side beams 3*a* extending in the driving direction and a cross beam 3*b* which extends in a rightward and leftward direction and is connected to the right and left side beams 3*a* in a position which is slightly rearward relative to the centers of the side beams 3*a*. The main axle 6 extending in the rightward and leftward direction is rotatably attached to axle boxes 23 having bearings 10 in a position which is slightly forward relative to the centers of the side beams 3*a* Each axle box 23 is elastically coupled to the bogie frame 3 by an axle box suspension 25 including a spring. The large-diameter wheels 7 are integrally attached to the right and left sides of the main axle 6 in a position which is inward relative to the side beams 3*a* in the rightward and leftward direction. The main axle 6 is provided with a drive device 11 including a gearing and a flexible joint. An electric motor 12 is mounted to the cross beam 3*b* such that its power can be transmitted to the drive device 11. To be specific, the rotational force of the electric motor 12 is transmitted to the main axle 6 via the drive device 11. An end beam 13 extending in the rightward and leftward direction is attached to the front end portions of the side beams 3*a* such that the end beam 13 extends vertically. A brake device (not shown) is mounted to the main axle 6 or the large-diameter wheels 7. Alternatively, a brake device may be mounted to the small-diameter wheel 9.

Each side beam 3*a* has at a rear end portion a fork portion 3*c* which is two branched portions extending in a rearward direction when viewed from above. The axle box suspension 26 is coupled to the fork portion 3*c*. The axle box suspension 26 supports the axle box 24 which rotatably supports the sub-axle 8 by means of the bearing 15. The fork portion 3*c* has a pivot hole 3*d* whose axis extends in the rightward and leftward direction. The fork portion 3*c* is provided with a lower spring receiver member 3*e* protruding outward in the rightward and leftward direction in front of the pivot hole 3*d*. In a space defined by the fork portion 3*c*, a front end portion 4*a* of a support member 4 constituting the axle box suspension 26 is disposed. A pivot hole 4*b* is formed in the front end portion 4*a* of the support member 4 to correspond in position to the pivot hole 3*d* of the fork portion 3*c* such that the pivot hole 4*b* is coaxial with the pivot hole 3*d*. A coupling pin 14 is rotatably inserted into the pivot hole 3*d* of the fork portion 3*c* and the pivot hole 4*b* of the support member 4. In other words, the support member 4 is vertically pivotable with respect to the bogie frame 3 around a pivot axis of the coupling pin 14 extending in the rightward and leftward direction.

The axle box 24 is attached to a rear end portion 4*c* of the support member 4 and rotatably supports the sub-axle 8 extending in the rightward and leftward direction by means of the bearing 15. Small-diameter wheels 9 which have a smaller outer diameter than large-diameter wheels 7 are integrally attached to the right and left sides of the sub-axle 8 in a position which is inward relative to the respective support members 4 in the rightward and leftward direction. To be specific, the outer diameter of the small-diameter wheels 9 is less than a half of that of the large-diameter wheels 7. For example, the outer diameter of the large-diameter wheel 7 is 500~750 mm and the outer diameter of the small-diameter wheels 9 is 200~350 mm. The upper end of the small-diameter wheel 9 in a stationary state is located lower than the rotational center of the large-diameter wheel 7. The upper end of the support member 4 which corresponds to the small-diameter wheel 9 is located lower than the upper end of the small-diameter wheel 9 in a stationary state. The height of the upper end of the support member 4 which corresponds to the small-diameter wheel 9, from the ground is, for example 300~400 mm, and preferably 350 mm or less. The outer diameter of the small-diameter wheels 9 need not be less than a half of that of the large-diameter wheels 7, but may be not less than the half of that of the large-diameter wheels 7 if the floor surface of the car body 21 is sufficiently lowered.

An upper spring receiver member 4*d* which is substantially L-shaped when viewed from above is provided at the center portion of the support member 4 in the diving direction such that the upper spring receiver member 4*d* protrudes outward in the rightward and leftward direction. The upper spring receiver member 4*d* extends forward and above the lower spring receiver member 3*e* of bogie frame 3. A coil spring 16 (elastic body) which is vertically compressive is mounted between the upper spring receiver member 4*d* and the lower spring receiver member 3*e* in a compressed state. To be specific, the coil spring 16 applies a force to the upper spring receiver member 4*d* in an upward direction with respect to the lower spring receiver member 3*e*, in front of the coupling pin 14 which is the pivot axis, thereby allowing the small-diameter wheel 9 behind the coupling pin 14 to be subjected to a downward force.

A bogie bolster 5 extends in the rightward and leftward direction above the bogie frame 3 and is connected to the bogie frame 3 via a connecting device 17 (center pivot), thereby allowing the bogie bolster 5 to horizontally rotate with respect to the bogie frame 3. Air springs 18 are mounted to the upper surface of the bogie bolster 5 at the right and left sides. The car body 21 is supported by the upper end portions of the air springs 18. Bogie brackets 19 protrude rearward from the bogie bolster 5 and the front end portions of bolster anchors 20 are coupled to the bogie brackets 19, respectively.

When a distance in the driving direction between a rotational center C1 of the connecting device 17 and a rotational center C2 of the large-diameter wheel 7 is L1 and a distance in the driving direction between the rotational center C1 of the connecting device 17 and a rotational center C3 of the small-diameter wheel 9 is L2, L2 is large than L1. To be specific, L2 is set to a length which is approximately twice as large as L1. The main axle 6 and the large-diameter wheels 7 receive about ⅔ of a load applied by the car body 21 to the bogie 1, while the sub-axle 8 and the small-diameter wheels 9 receive about ⅓ of the load.

The car body 21 has a high-floor surface 21*a* which is substantially located above the bogie frame 3, a low-floor surface 21*c* which is located above the small-diameter wheels 9 and a vertical surface 21*b* connecting the rear end of the high-floor surface 21*a* to the front end of the low-floor surface 21*c*. The high-floor surface 21*a* is supported by the air springs 18 from below. The low-floor surface 21*c* is positioned in close proximity to the small-diameter wheels 9 with a slight clearance between them. Car body brackets 22 are attached to the vertical surface 21*b* so as to protrude forward. The rear end portion of the bolster anchor 20 is coupled to each car body bracket 22 to allow the bogie bracket 19 to be coupled to the car body bracket 22.

Figure 4:
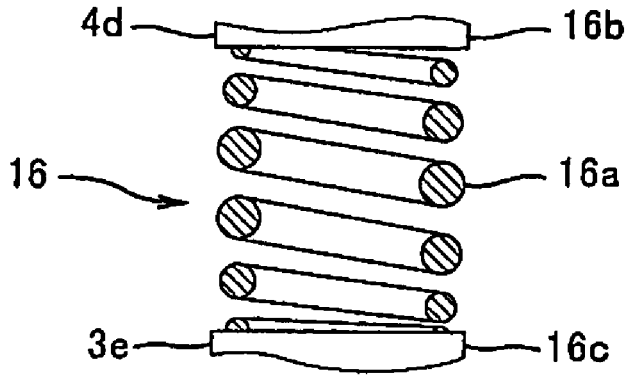
FIG. 4 is a cross-sectional view of a coil spring of the bogie of FIG. 1.
Figure 5:
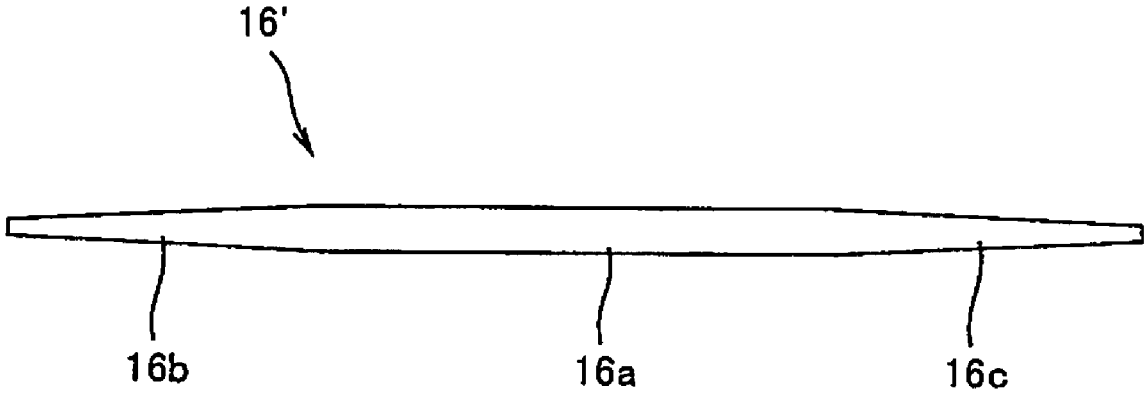
FIG. 5 is a view showing a linear member used for a coil spring of FIG. 4.

FIG. 4 is a cross-sectional view of the coil spring 16 of the bogie 1 of FIG. 1. FIG. 5 is a view showing a linear member 16' used for the coil spring 16 of FIG. 4. As shown in FIGS. 4 and 5, the coil spring 16 is formed by bending a linear member 16' having an inconstant cross-sectional area in a spiral shape. As shown in FIG. 5, the linear member 16' has a thick rod portion 16*a* which is located at a center section in the longitudinal direction thereof and has a constant cross-sectional area and tapered rod portions 16*b* and 16*c* which are continuous with the both sides of the thick rod portion 16*a* and have a diameter decreasing toward tip ends. As shown in FIG. 4, the coil spring 16 formed by the linear member 16' has a structure in which their upper and lower portions connected to the upper spring receiver member 4*d* and the lower spring receiver member 3*e*, respectively, have a smaller cross-sectional area than the center portion in the vertical direction. With this structure, the coil spring 16 has a non-linear spring constant with respect to an expansion and compression amount.

To be more specific, when an external force is applied to cause the upper spring receiver member 4*d* and the lower spring receiver member 3*e* to be close to each other, the tapered rod portions 16*b* and 16*c* which have lower stiffness than the thick rod portion 16*a* which has higher stiffness, start to be compressed preferentially. During a state where the compression amount of the coil spring 16 is still small, the spring constant of the coil spring 16 is small. As the compression amount of the coil spring 16 increases, a space in which the tapered rod portions 16*b* and 16*c* are compressed decreases, and as a result, the compression of the thick rod portion 16*a* primarily starts. Thus, as the compression amount of the coil spring 16 increases, the spring constant of the coil spring 16 increases. The coil spring 16 is configured to increase its spring constant as a vertical pivot movement amount of the support member 4 around the coupling pin 14 with respect to the bogie frame 3 increases.

In accordance with the above, since the large-diameter wheels 7 are arranged forward in the driving direction and the small-diameter wheels 9 are arranged behind the large-diameter wheels 7 in the driving direction, the large-diameter wheels 7 can maintain driving stability and the floor surface of the car body 21 located above the small-diameter wheels 9 can be made lower. In addition, since the upper end of the axle box suspension 26 which corresponds to the small-diameter wheel 9 is lower than the upper end of each small-diameter wheel 9 and the upper end of the small-diameter wheel 9 is lower than the rotational center of the large-diameter wheel 7, a sufficient space is provided above and near the small-diameter wheel 9 and therefore a portion of the car body 21 which is located above the small-diameter wheel 9 can be made significantly lower. Furthermore, since the small-diameter wheels 9 are coupled to each other by the sub-axle 8 extending in the rightward and leftward direction, the distance between the right and left small-diameter wheels 9 is maintained accurately so as to be equal to the distance between the rails, thereby improving driving stability.

Since the small-diameter wheels 9 are subjected to a downward force by the coil springs 16 via the support members 4 with respect to the bogie frame 3 supporting the large-diameter wheels 3 which receive a greater part of the load applied by the car body, adhesion of the lightweight small-diameter wheels 9 to the rails can be improved. In addition, when the vertical pivot movement amount of the support members 4 with respect to the bogie frame 3 is small, the spring constant of the coil springs 16 is small. Therefore, the small-diameter wheels 9 are vertically displaceable flexibly with respect to the large-diameter wheels 7, and the small-diameter wheels 9 can smoothly follow the large-diameter wheels 7 along the rails. On the other hand, when the vertical pivot movement amount of the support members 4 with respect to the bogie frame 3 is larger, the constant spring of the coil springs 16 is larger. Therefore, the small-diameter wheels 9 are difficult to displace vertically. As a result, it is possible to prevent the small-diameter wheels 9 from contacting the low-floor portion 21*c*.

Although in this embodiment, the coil spring 16 is used as the elastic body, the elastic body is not limited to this so long as it is capable of applying a force. For example, an elastic member made of rubber or the like, or a leaf spring may be used.

(Embodiment 2)

Figure 6:
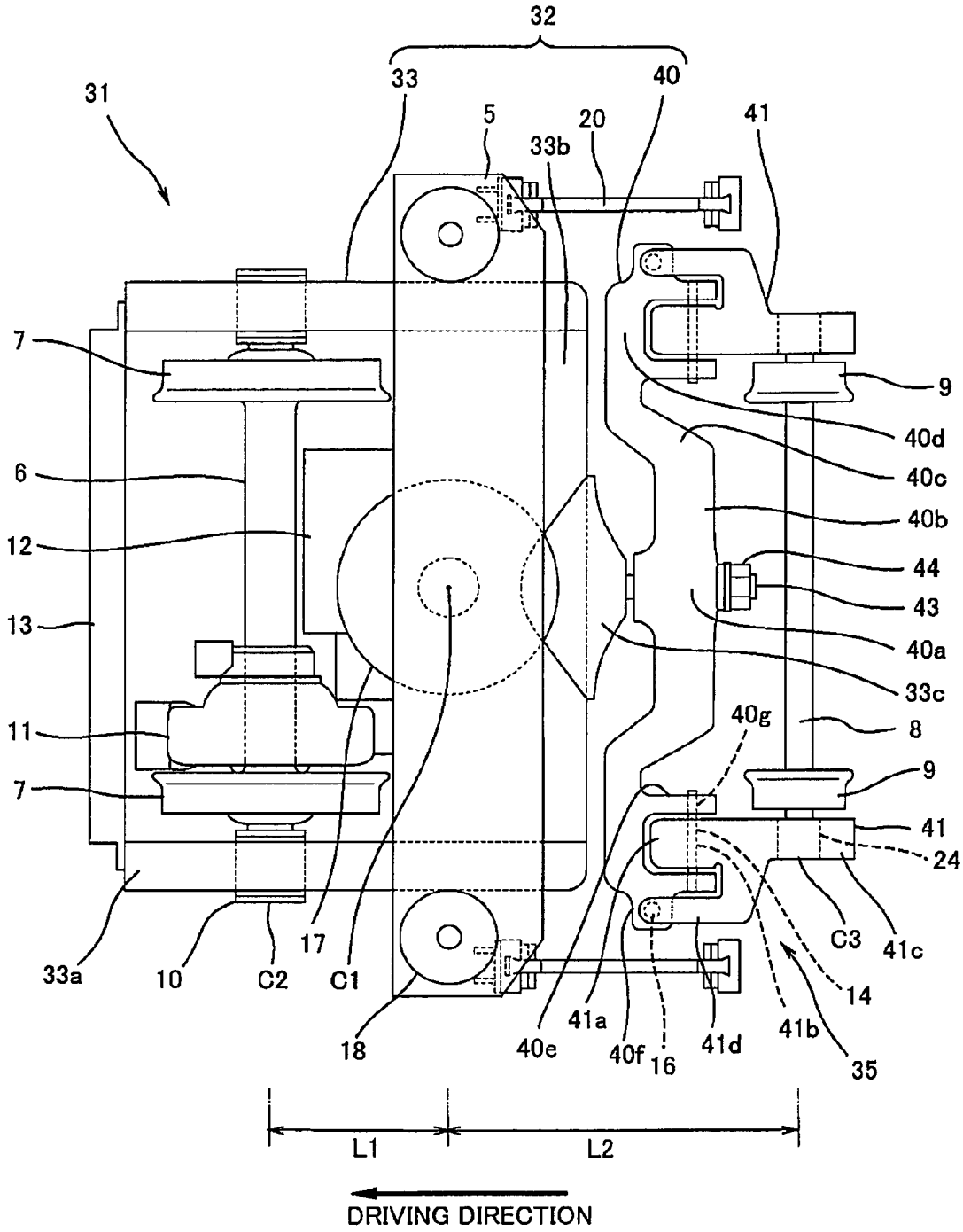
FIG. 6 is a plan view of a low-floor railway vehicle bogie according to Embodiment 2 of the present invention.
Figure 7:
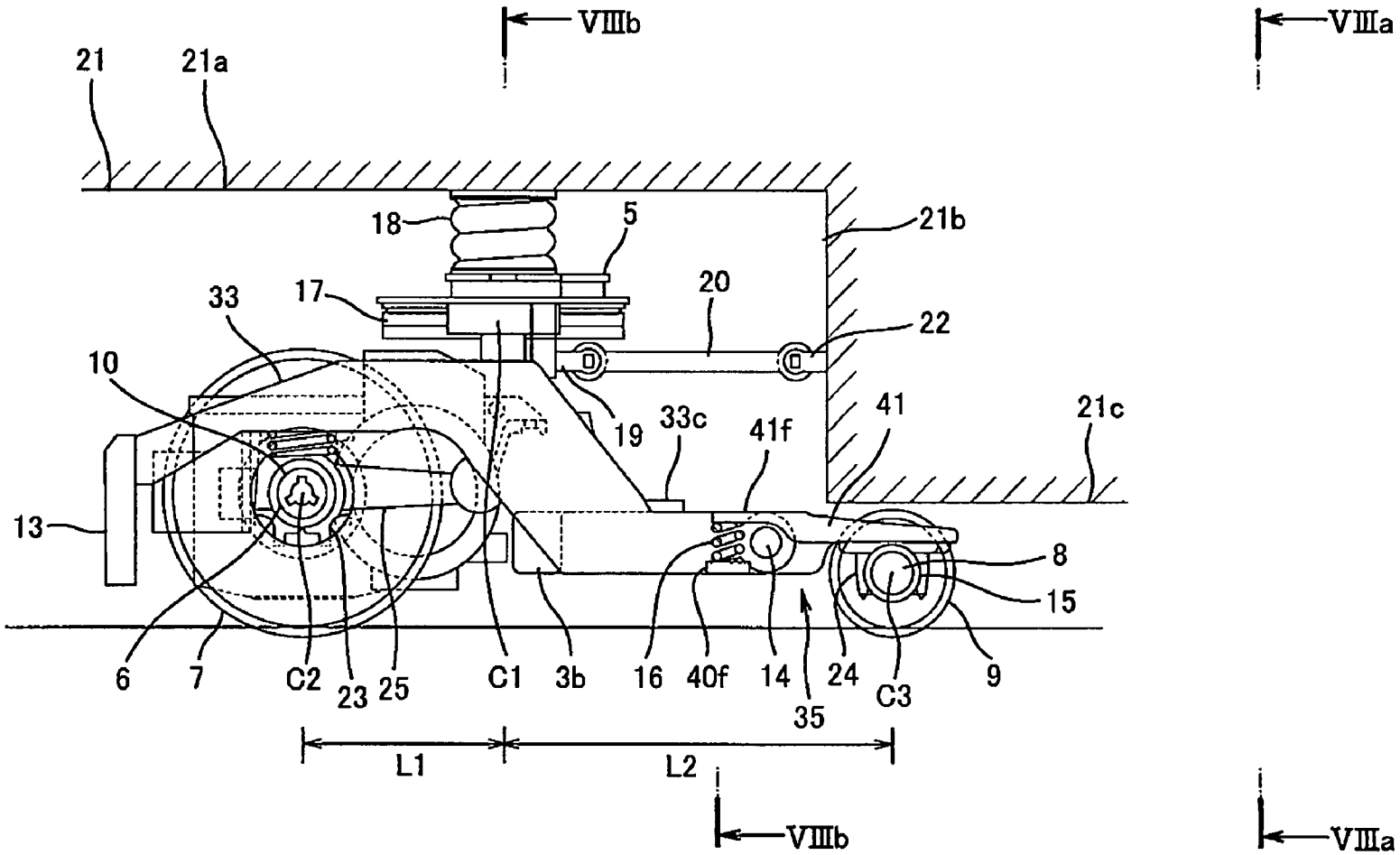
FIG. 7 is a side view of the bogie of FIG. 6.
Figure 8:
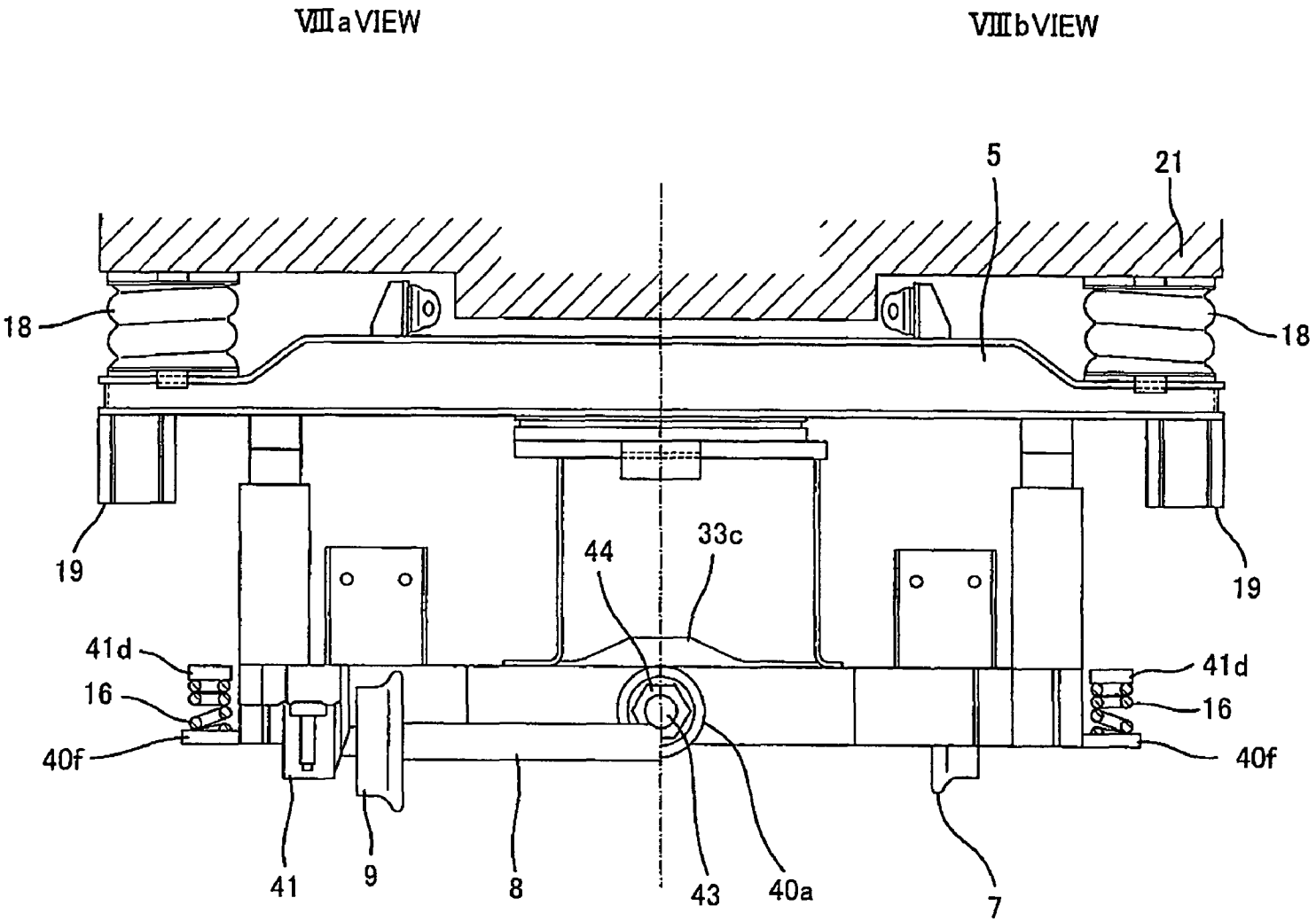
FIG. 8 is a rear view showing a left-half part taken in the direction of VIIIa of FIG. 7 and a right-half part taken in the direction of VIIIb of FIG. 2.

FIG. 6 is a plan view of a low-floor railway vehicle bogie 31 according to Embodiment 2 of the present invention. FIG. 7 is a side view of the bogie 31 of FIG. 6. FIG. 8 is a rear view showing a left-half part taken in the direction of VIIIa of FIG. 7 and a right-half part taken in the direction of VIIIb of FIG. 7. In FIG. 6, leftward indicates forward in the driving direction, rightward indicates rearward in the driving direction, the upper sides indicates the right side, and the lower sides indicates the left side. The same constituents as those in Embodiment 1 are designated by the same reference numerals as those in Embodiment 1 and detailed description thereof will be omitted.

As shown in FIGS. 6 to 8, the bogie 31 of this embodiment has a bogie frame 3 supporting the car body 21. The main axle 6 and the sub-axle 8 are rotatably attached to the bogie frame 3. The pair of large-diameter wheels 7 are attached to right and left sides of the main axle 6, and the pair of small-diameter wheels 9 are attached to right and left sides of the sub-axle 8.

The bogie frame 32 includes a first frame member 33 disposed forward in the driving direction, and a second frame member 40 coupled to the rear side of the first frame member 33. The first frame member 33 includes a pair of right and left side beams 33*a* extending in the driving direction, a cross beam 33*b* which extends in the rightward and leftward direction and is attached to the rear end portions of the right and left side beams 33*a* to extend in the rightward and leftward direction, and a pivot fixing member 33*c* protruding slightly rearward from the center portion of the cross beam 33*b* in the rightward and leftward direction. The main axle 6 extending in the rightward and leftward direction is rotatably attached to the side beams 33*a* by axle boxes 23 having bearings 10 in a position which is slightly forward relative to the centers of the side beams 33*a*. Each axle box 23 is elastically coupled to the first frame member 33 by means of an axle box suspension 25 having a spring. The large-diameter wheels 7 are integrally fixed to the right and left sides of the main axle 6 in a position which is inward relative to the side beams 33*a*. The front end portion of a pivot 43 protruding rearward is pressed into and fixed to the pivot fixing member 33*c*. The pivot 43 is positioned at the center between the right and left small-diameter wheels 9 when viewed from behind.

The second frame member 40 includes a tubular portion 40*a* into which the pivot 43 is rotatably inserted, a pair of first cross beam portions 40b extending in the rightward and leftward direction from the tubular portion 40a, a pair of second cross beam portions 40*c* extending forward obliquely in the rightward and leftward direction, respectively from the first cross beam portions 40*b*, a pair of third cross beam portions 40*d* extending in the rightward and leftward direction from the second cross beam portions 40*c*, and fork portions 40*e* each of which is two branched portions when viewed from above and extends rearward from the third cross beam portion 40*d*. In other words, the second frame member 40 is curved in a forward direction in a direction from the tubular portion 40*a* outward in the rightward and leftward direction. Thereby, the fork portions 40*e* are located right beside the tubular portion 40*a* and in close proximity to the first frame member 33. A threaded portion is formed at the outer peripheral surface of the rear end of the pivot 43 protruding rearward from the tubular portion 40*a*, and a nut 44 is threadedly engaged with the threaded portion. In other words, the second frame member 40 is coupled to the first frame member 33 such that the second frame member 40 is pivotable in a roll direction around the pivot 43 which is rotational axis.

An axle box suspension 35 is connected to each fork portion 40*e*. The axle box suspension 35 supports the axle box 24 which rotatably supports the sub-axle 8 by means of the bearing 15. The fork portion 40*e* has a pivot hole 40*g* whose axis extends in the rightward and leftward direction. The fork portion 40*e* is provided with a lower spring receiver member 40*f* protruding outward in the rightward and leftward direction in front of the pivot hole 40*g*. In a space defined by the fork portion 40*e*, a front end portion 41*a* of a support member 41 constituting the axle box suspension 35 is disposed. A pivot hole 41*b* is formed in the support member 41 to correspond in position to the pivot hole 40*g* of the fork portion 40*e* such that the pivot hole 41*b* is coaxial with the pivot hole 40*g*. The coupling pin 14 is rotatably inserted into the pivot hole 40*g* of the fork portion 40*e* and the pivot hole 41*b* of the support member 41. In other words, the support member 41 is vertically pivotable with respect to the second frame member 40 around the coupling pin 14 having a pivot axis extending in the rightward and leftward direction. The sub-axle 8 extending in the rightward and leftward is rotatably attached to rear end portions 41*c* of the support members 41 by means of the bearings 15. The small-diameter wheels 9 are integrally attached to the right and left sides of the sub-axle 8 in a position which is inward relative to the support members 4 in the rightward and leftward direction.

An upper spring receiver member 41*d* which is substantially L-shaped when viewed from above is provided at the center portion of the support member 41 in the diving direction such that the upper spring receiver member 41*d* protrudes outward in the rightward and leftward direction. The upper spring receiver member 41*d* extends forward and above the lower spring receiver member 40*f* of the second frame member 40. The coil spring 16 (elastic body) which is vertically compressive is mounted between the upper spring receiver member 41*d* and the lower spring receiver member 40*f* in a compressed state. To be specific, the coil spring 16 applies a force to the upper spring receiver member 41*d* in an upward direction with respect to the lower spring receiver member 40*f*, in front of the coupling pin 14 which is the pivot, thereby allowing the small-diameter wheel 9 behind the coupling pin 14 to be subjected to a downward force.

The bogie bolster 5 extends in the rightward and leftward direction above the first frame member 33 and is connected to the first frame member 33 via the connecting device 17, thereby allowing the bogie bolster 5 to horizontally rotate with respect to the first frame member 33. When a distance in the driving direction between the rotational center C1 of the connecting device 17 and the rotational center C2 of the large-diameter wheel 7 is L1 and a distance in the driving direction between the rotational center C1 of the connecting device 17 and the rotational center C3 of the small-diameter wheel 9 is L2, L2 is large than L1. To be specific, L2 is set to a length which is approximately twice as large as L1.

Figure 9:
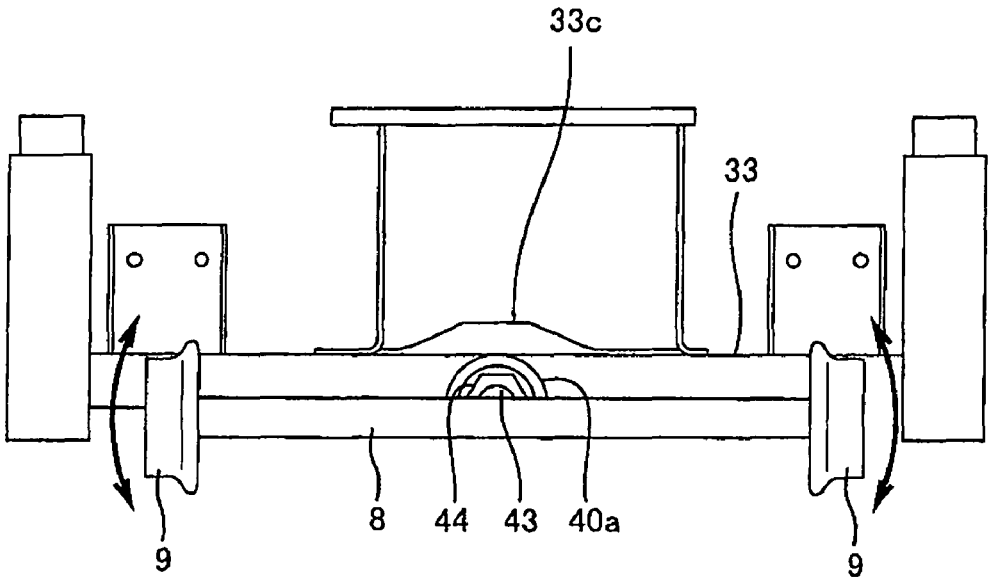
FIG. 9 is a rear view of major constituents for explaining a pivot movement of small-diameter wheels of FIG. 6.

FIG. 9 is a rear view of major constituents for explaining a pivot movement of the small-diameter wheels 9 of FIG. 6. As shown in FIG. 9, the support member 41 supporting the axle boxes 24 for supporting the sub-axle 8 provided with the small-diameter wheels 9 at right and left sides is pivotable with respect to the first frame member 33 around the pivot 43 in the roll direction. Therefore, for example, if an upward external force is applied to one of the right and left small-diameter wheels 9, the second frame member 40 is pivoted around the pivot 43 in the roll direction together with the axle box suspension 35, so that the other small-diameter wheel 9 is subjected to a downward force.

In accordance with the above configuration, even when a pressing force in a gravitational force direction which is applied by one of the right and left small-diameter wheels 9 to the rail increases or decreases, the second frame member 40 rotates in the roll direction such that the load is applied by the car body 21 evenly to the pair of right and left small-diameter wheels 9. This can improve driving stability. Further, since the small-diameter wheels 9 are subjected to a downward force by the coil springs 16 via the support members 41 with respect to the second frame member 40 coupled to the first frame member 33 supporting the large-diameter wheels 7 adapted to receive a greater part of the load from the car body, adhesion of the lightweight small-diameter wheels 9 to the rails can be improved. The other constituents are the same as those in Embodiment 1 and will not be described repetitively.

(Embodiment 3)

Figure 10:
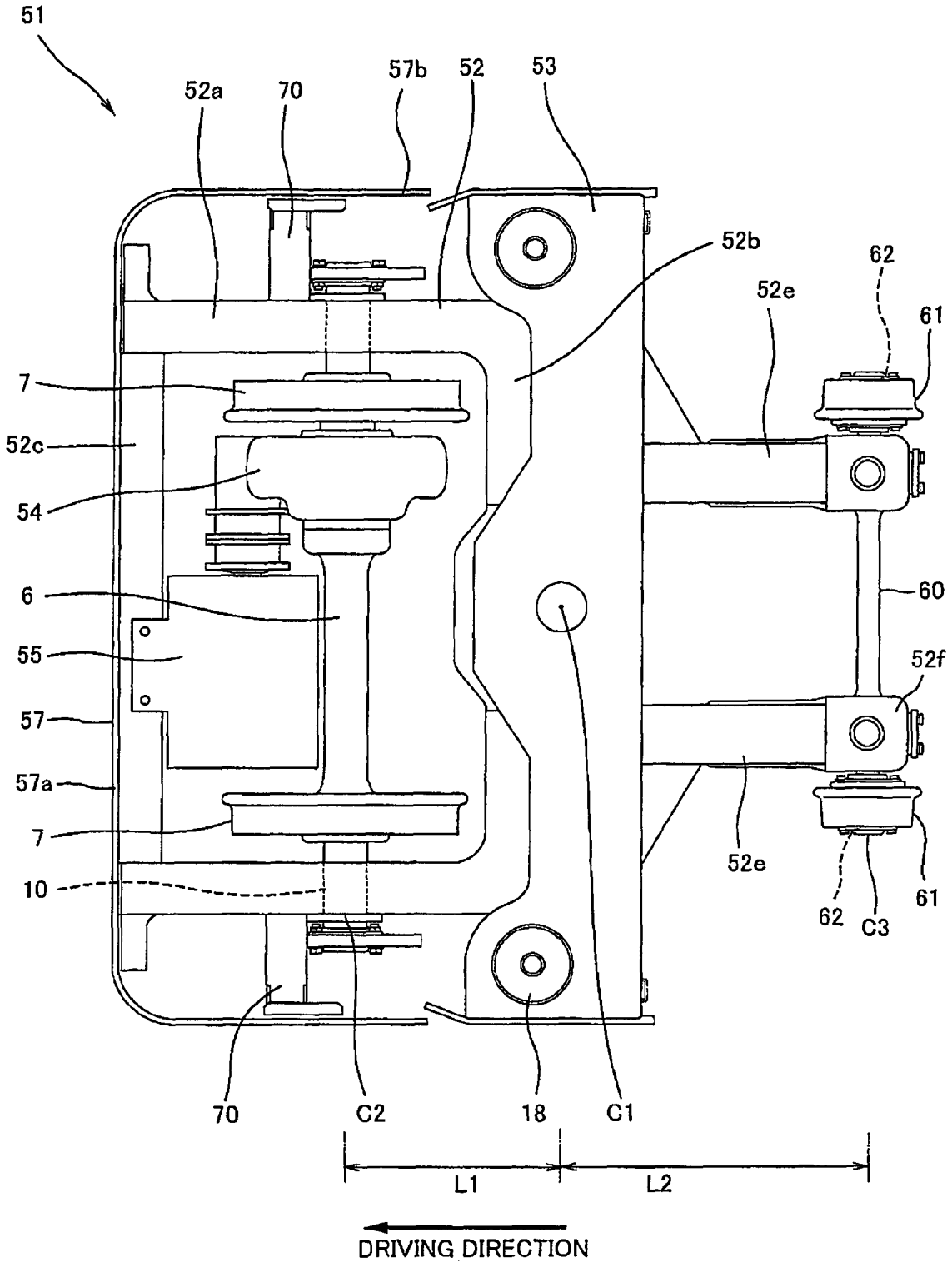
FIG. 10 is a plan view of a low-floor railway vehicle bogie according to Embodiment 3 of the present invention.
Figure 11:
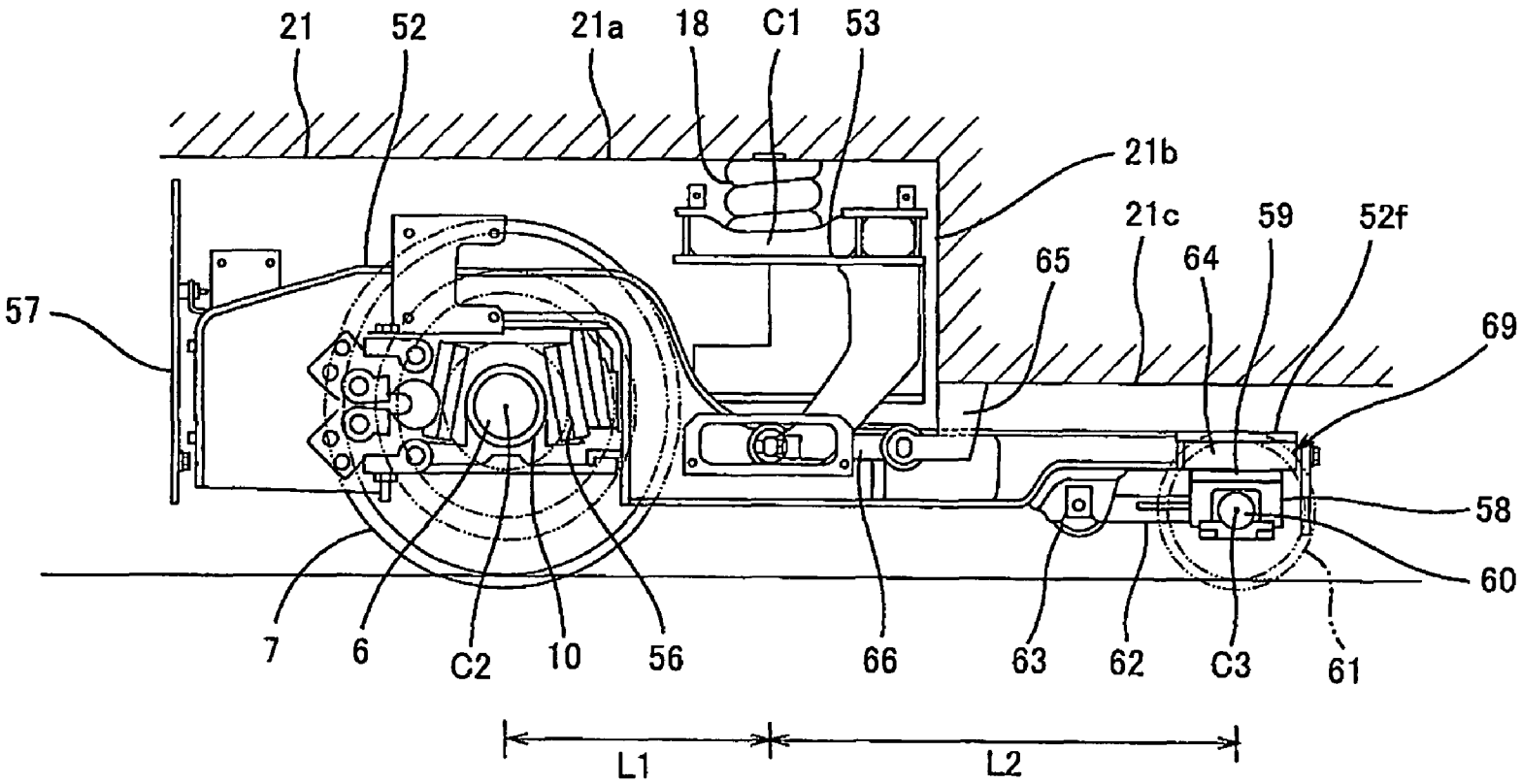
FIG. 11 is a side view of the bogie of FIG. 10.

FIG. 10 is a plan view of a low-floor railway vehicle bogie 51 according to Embodiment 3 of the present invention. FIG. 11 is a side view of the bogie 51 of FIG. 10. In FIG. 10, leftward indicates forward in the driving direction, rightward indicates rearward in the driving direction, the upper side indicates the right side, and the lower side indicates the left side. The same constituents as those in Embodiment 1 are designated by the same reference numerals as those in Embodiment 1 and detailed description thereof will be omitted.

As shown in FIGS. 10 and 11, the bogie 51 of this embodiment includes a bogie bolster 53 and a bogie frame 52 for supporting the car body 21. The main axle 6 and a sub-axle 60 are attached to the front and rear sides of the bogie frame 52. The pair of right and left large-diameter wheels 7 are attached to the right and left sides of the main axle 6, respectively. A pair of small-diameter wheels 61 are attached to the right and left sides of the sub-axle 60, respectively.

The bogie frame 52 includes a pair of right and left front side beams 52*a* extending in the driving direction, a cross beam 52*b* which extends in the rightward and leftward direction and is connected to the rear end portions of the right and left front side beams 52*a*, and an end beam 52*c* which extends in the rightward and leftward direction and is connected to the front end portions of the right and left front side beams 52*a*, and rear side beams 52*e* protruding rearward from positions between the right and left end portions of the cross beam 52*b* and the center portion of the cross beam 52*b*. A guard plate 57 extends vertically at the front end portion of the end beam 52*c*. The guard plate 57 has a front plate portion 57*a* and side plate portions 57*b* and is horseshoe-shaped when viewed from above. The guard plate 57 is disposed to cover the front end portion to the side end portions of the bogie frame 52. Brackets 70 are attached to the front side beams 52*a* to protrude outward in the rightward and leftward direction, respectively. The side plate portions 57*b* of the guard plate 57 are supported by the brackets 70, respectively.

The main axle 6 extending in the rightward and leftward direction is rotatably attached to the substantially center portions of the front side beams 52*a* by means of bearings 10. The large-diameter wheels 7 are integrally attached to the right and left sides of the main axle 6 in a position which is inward relative to the front side beams 52*a* in the rightward and leftward direction, respectively. A chevron rubber axle spring member 56 is mounted to each bearing 10. A drive device 54 is mounted to the main axle 6. An electric motor 55 is mounted to the end beam 52*c* such that a driving power of the electric motor 55 can be transmitted to the drive device 54.

A bogie bolster 53 extends in the rightward and leftward direction above the cross beam 52*b*. The air springs 18 are mounted to the upper surface of the bogie bolster 53 at the right and left sides, respectively. The car body 21 is supported by the upper end portions of the air springs 18. The front end portion of a bolster anchor 66 is coupled to the bogie bolster 53 and coupled with the car body 21. The rear end portion of the bolster anchor 66 is coupled to a car body bracket 65 attached on the low-floor portion 21*c* of the car body 21.

An axle box 58 is attached to the lower surface of the rear end portion 52*f* of each rear side beam 52*e* by an axle box suspension 69. The sub-axle 60 is inserted into the axle box axle box 58. The axle box suspension 69 includes a support member 64 coupled to the axle box 58 via a rubber block 59 (elastic body), and an axle beam 62 protruding forward from the axle box 58. The front end portion of the axle beam 62 is mounted to a rubber bush 63 protruding from the lower surface of the rear side beam 52*e*. A pair of small-diameter wheels 61 are rotatably attached to the end portions of the sub-axle 60 which protrude outward in the rightward and leftward direction by bearings 62, respectively. In other words, the axle box suspensions 69 attached to the rear side beams 52*e* support the sub-axle 60 via the axle boxes 58 between the pair of small-diameter wheels 61, respectively. In a state where the sub-axle 60 is not substantially rotating, the right and left small-diameter wheels 61 are respectively independently rotatable.

The outer diameter of the small-diameter wheels 61 is less than a half of that of the large-diameter wheels 7. The upper end of the small-diameter wheel 9 in a stationary state is located lower than the rotational center of the large-diameter wheel 7. When a distance in the driving direction between a center C1 of the load applied by the car body 21 to the bogie bolster 53 and a rotational center C2 of the large-diameter wheel 7 is L1 and a distance in the driving direction between the center C1 of the load and a rotational center C3 of the small-diameter wheel 61 is L2, L2 is larger than L1. To be specific, L2 is set to a length which is approximately twice as large as L1.

In accordance with the above configuration, the rear side beams 52*e* support the sub-axle 60 between the small-diameter wheels 61 and are positioned inwardly relative to the small-diameter wheels 61, respectively. Therefore, a space is provided in a region outward relative to each small-diameter wheel 61 in the rightward and leftward direction to allow other constituents and members to be accommodated therein. Since the right and left small-diameter wheels 61 are respectively independently rotatable, they are able to roll smoothly on the rails, respectively, even when a railway track has a small curvature radius during driving in a curve, for example. Further, the guard plate 57 which is horseshoe-shaped when viewed from above extends vertically at the end beam 52*c* of the bogie frame 52 to protect the bogie 51 and devices constituting the bogie 51, such as the electric motor and the brake device, from obstacles from forward and from lateral. In a case where the bogie 51 is positioned at a head part of the vehicle, the car body 21 may dispense with a guard. The other constituents are similar to those of Embodiment 1, and will not be described repetitively.

Hereinafter, the low-floor railway vehicle to which the bogies 1, 31 and 51 of the above described embodiments are applied will be described. Since the bogies 1, 31, and 51 are applicable to the rail vehicle in the same manner, application of the bogie 1 of Embodiment 1 will be described hereinafter.

Figure 12:
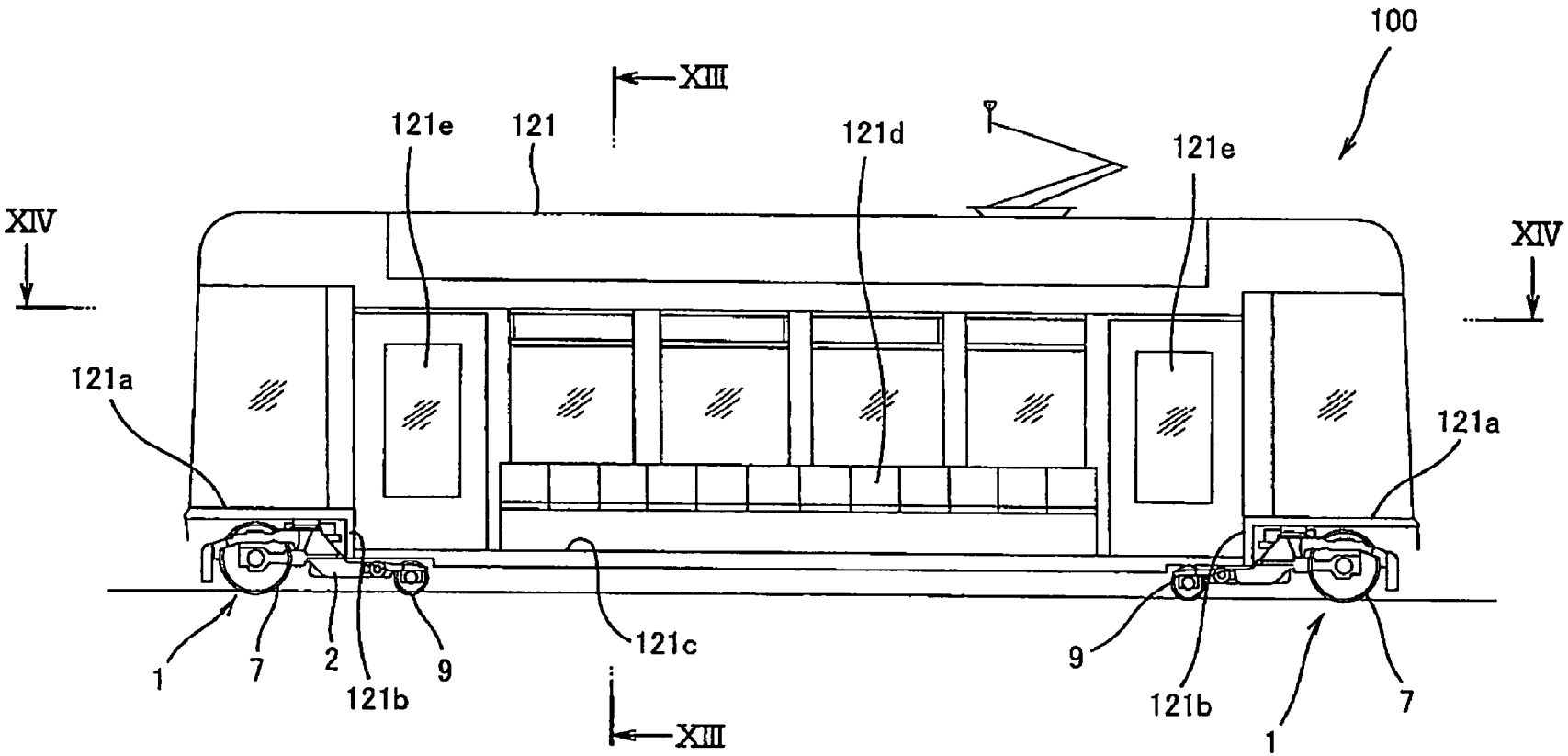
FIG. 12 is a side view of a low-floor railway vehicle to which the bogie of each embodiment is applied, a part of which is illustrated in a perspective view.
Figure 13:
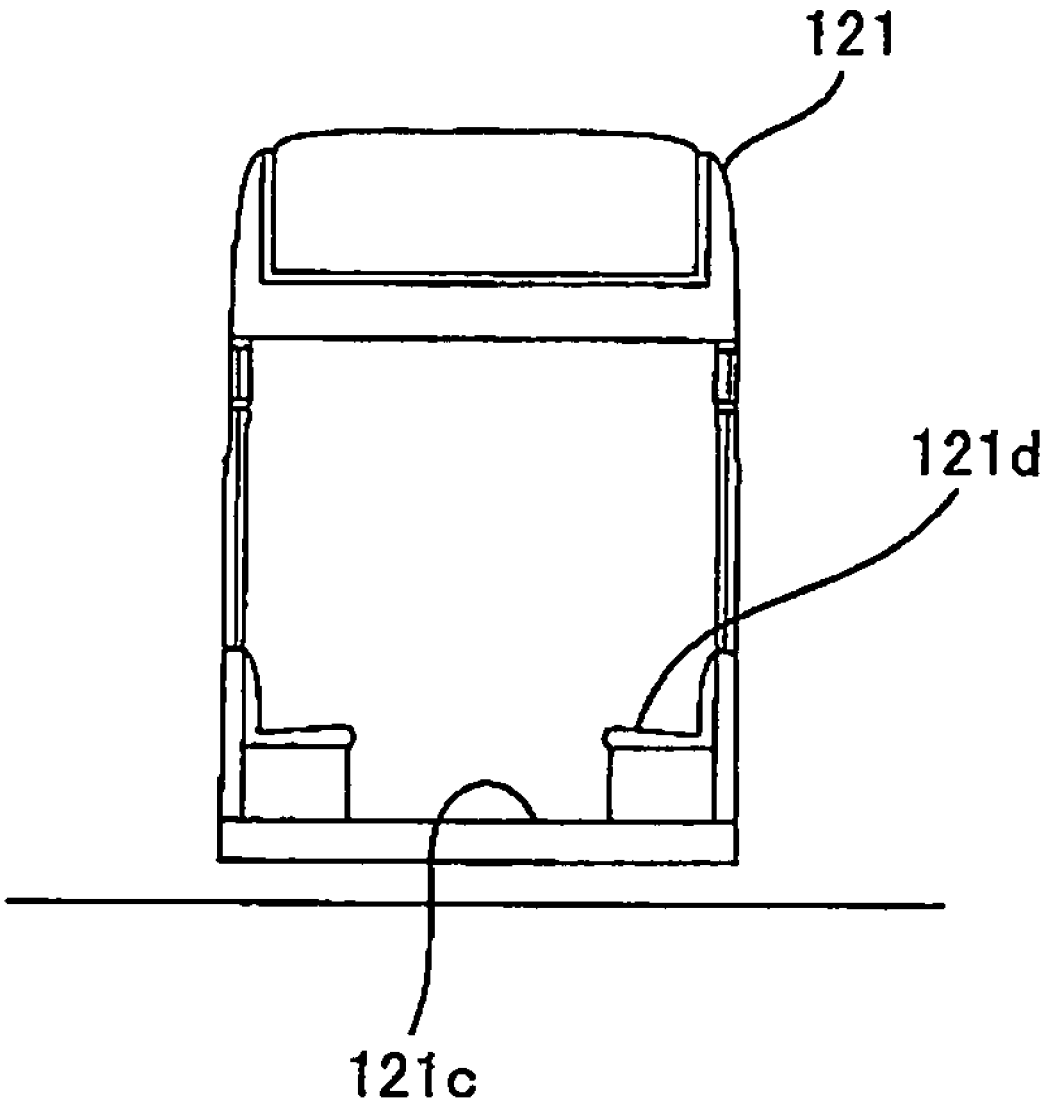
FIG. 13 is a cross-sectional view taken along line XIII-XIII of FIG. 12.
Figure 14:
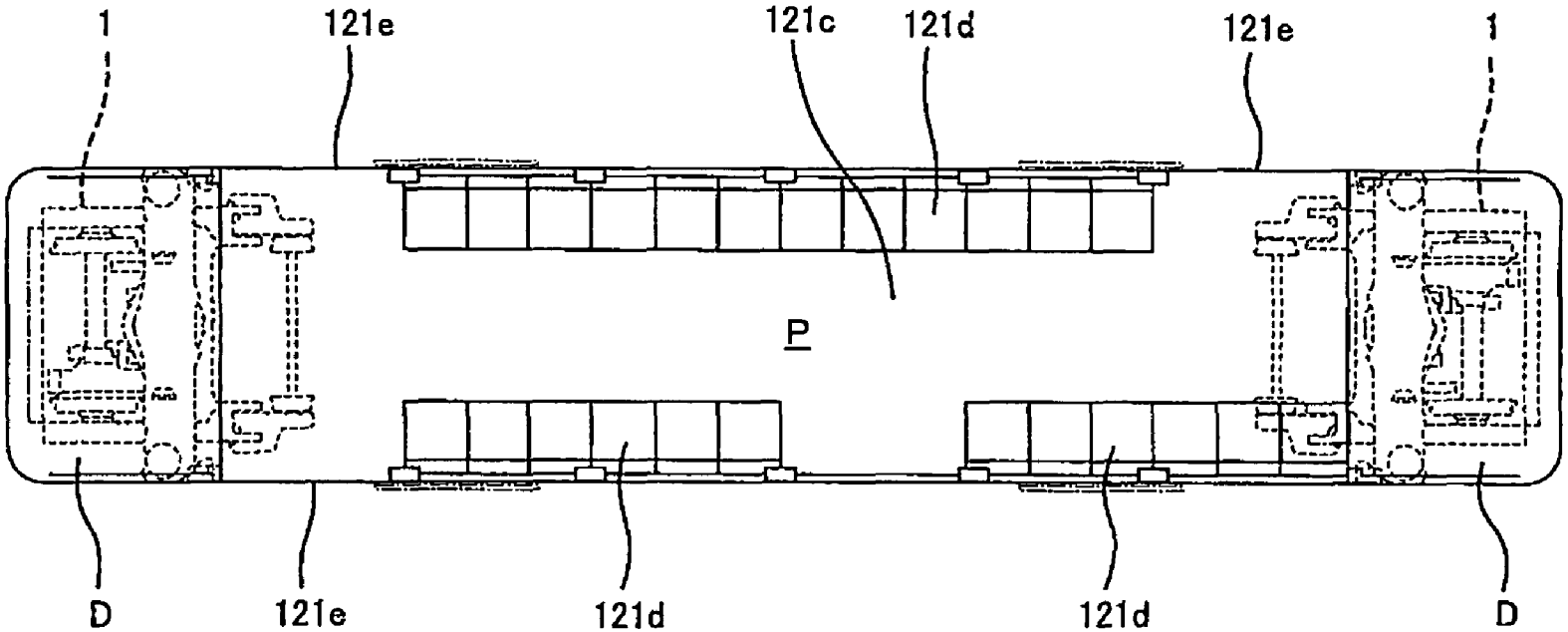
FIG. 14 is a cross-sectional view taken along line XIV-XIV of FIG. 12.

FIG. 12 is a side view of a low-floor railway vehicle 100 to which the bogie 1 of Embodiment 1 is applied, a part of which is illustrated in a perspective way. FIG. 13 is a cross-sectional view taken along line XIII-XIII of FIG. 12. FIG. 14 is a cross-sectional view taken along line XIV-XIV of FIG. 12. As shown in FIGS. 12 to 14, the railway vehicle 100 of this embodiment is a light rail vehicle consisting of a single car. The bogies 1 support the front end portion and rear end portion of the car body 121, respectively. The front bogie 1 is configured such that the large-diameter wheels 7 are positioned closer to the front end of the car body 121 and the small-diameter wheels 9 are positioned closer to the center of the car body 21 body 121 in the driving direction. The rear bogie 1 is configured such that the large-diameter wheels 7 are positioned closer to the rear end of the vehicle body 121 and the small-diameter wheels 9 are disposed closer to the center of the car body 121 in the driving direction.

Driver cabins D are provided at the front end portion and the rear end portion of the car 121, respectively. A boarding space between the front and rear driver cabins D is a passenger cabin P. The driver cabins D are positioned above the large-diameter wheels 7 and the floors of the driver cabins D are high-floor portions 121*a*. A part of the passenger cabin P is located above the small-diameter wheels 9. The entire surface of the floor of the passenger cabin P is a low-floor portion 121*c* except for seats 21*d*. Entrances 21*e* are provided in the passenger cabin P on a side wall of the vehicle body 121 adjacent the driver cabins D. In other words, the entrances 121*e* are provided above the small-diameter wheels 9.

In accordance with the above configuration, since the large-diameter wheels 7 of the bogies 1 are positioned closer to the end portions of the car body 121 in the driving direction, and the small-diameter wheels 9 of the bogies 1 are positioned closer to the center of the car body 121 in the driving direction, the large-diameter wheels 7 can maintain driving stability and the low-floor portion 121*c* can be extended from the center of the car body 121 to a region above the small-diameter wheels 9.

Figure 15:
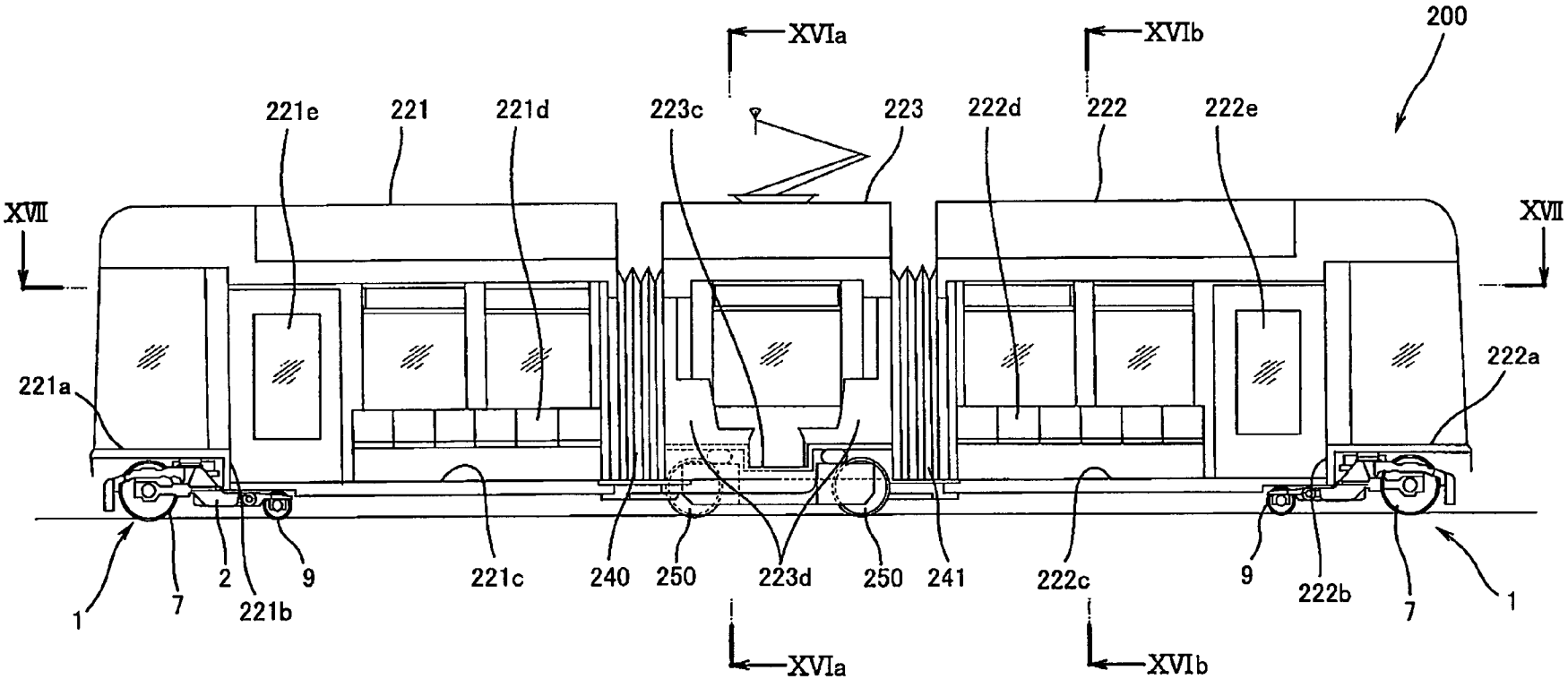
FIG. 15 is a side view of another low-floor railway vehicle to which the bogie of each embodiment is applied, a part of which is illustrated in a perspective view.
Figure 16:
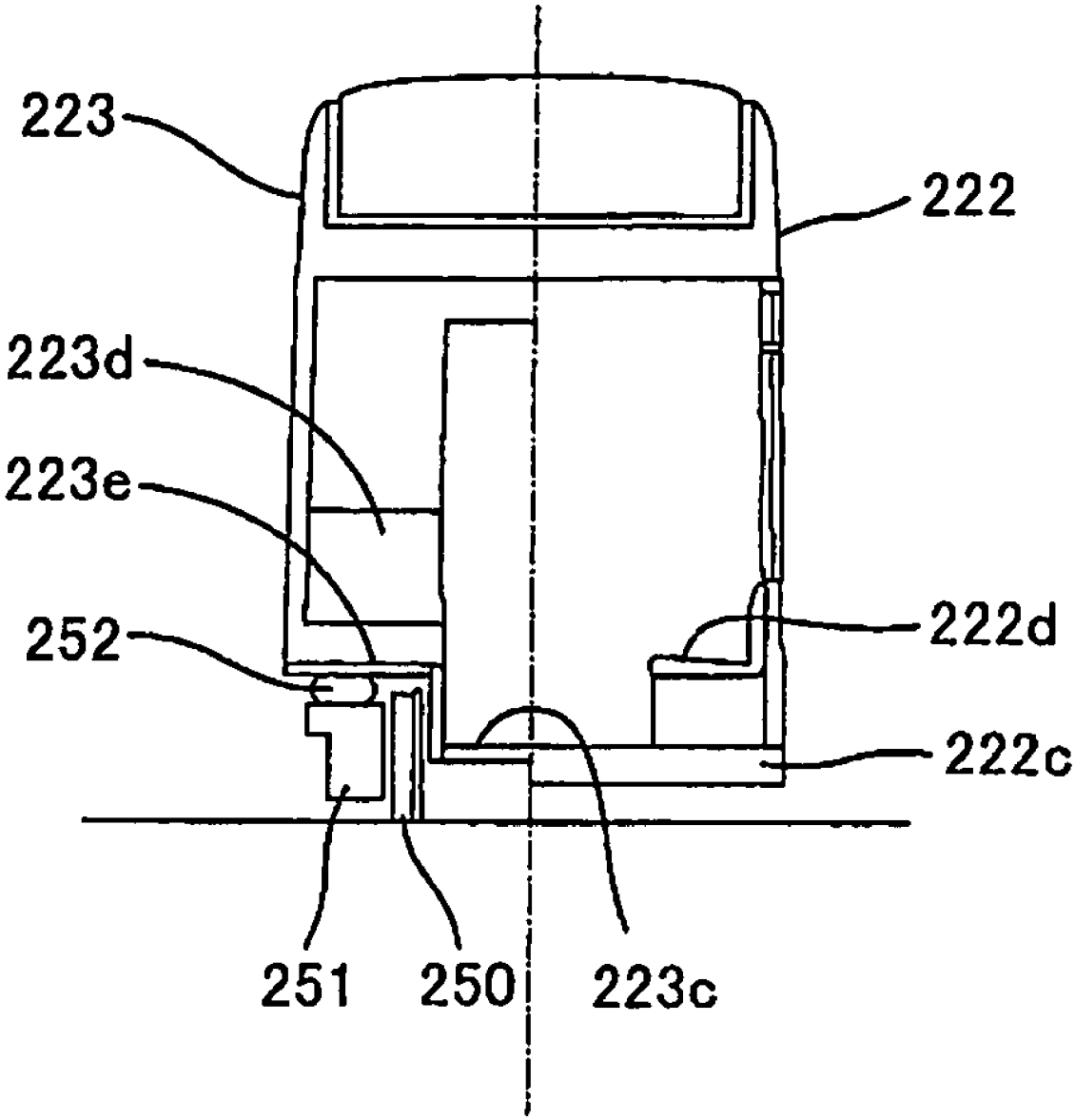
FIG. 16 is a cross-sectional view showing a left-half part taken along line XVIa-XVIa of FIG. 16 and a right-half part taken along line XVIb-XVIb of FIG. 16.
Figure 17:
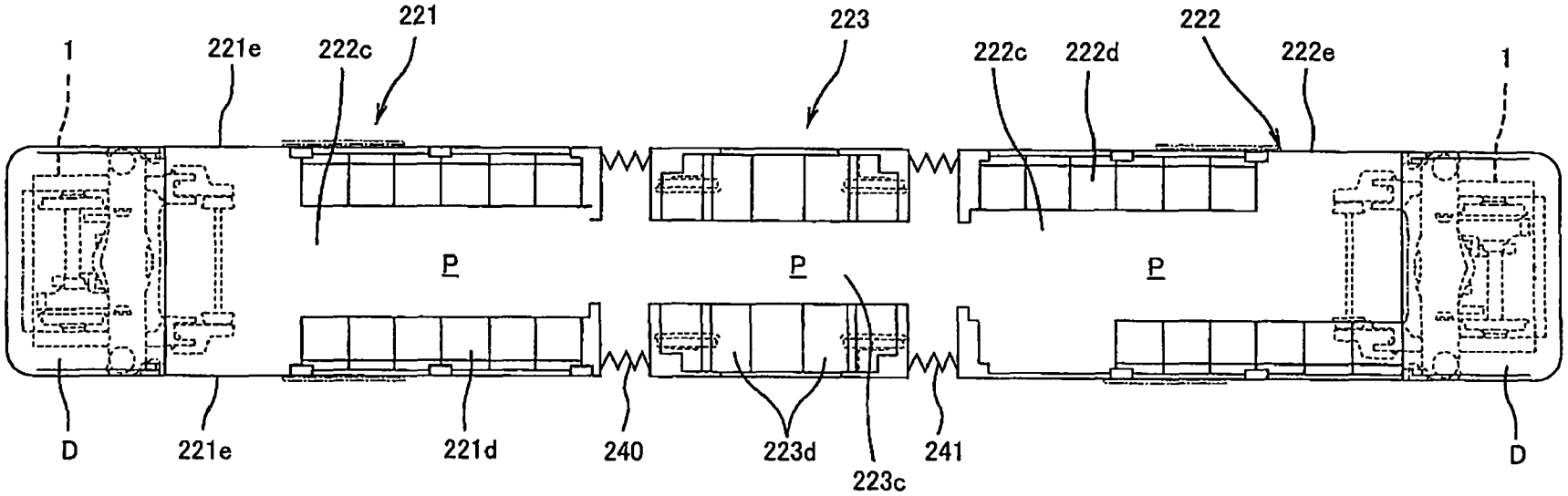
FIG. 17 is a cross-sectional view taken along line XVII-XVII of FIG. 16.

FIG. 15 is a side view of another low-floor railway vehicle to which the bogie 1 of Embodiment 1 is applied, a part of which is illustrated in a perspective way. FIG. 16 is a cross-sectional view showing a left-half part taken along line XVIa-XVIa of FIG. 16 and a right-half part taken along line XVIb-XVIb of FIG. 16. FIG. 17 is a cross-sectional view taken along line XVII-XVII of FIG. 15. As shown in FIGS. 15 to 17, a railway vehicle 200 of this embodiment consists of three cars. Car bodies 221 and 222 provided with driver cabins D are coupled to the front and rear sides of a car body 223 exclusive for the passenger cabin P. At coupling sections between adjacent car bodies of the car bodies 221 to 223, vestibule diaphragms 240 and 241 are provided to cover coupling aisles, respectively.

The front end portion of the head car body 221 and the rear end portion of the tail car body 222 are supported by the bogies 1, respectively. The head bogie 1 is configured such that the large-diameter wheels 7 are positioned closer to the front end of the car body 221 and the small-diameter wheels 9 are positioned closer to the center of the car body 221 in the driving direction. The tail bogie 1 is configured such that the large-diameter wheels 7 are positioned closer to the rear end of the car body 222 and the small-diameter wheels 9 are positioned closer to the center of the car body 222 in the driving direction.

Driver cabins D are provided at the front end portion of the car body 221 and the rear end portion of the car body 222, respectively, and a boarding space between the front and rear driver cabins D extends continuously as the passenger cabin P. The driver cabins D are positioned above the large-diameter wheels 7 and the floors of the driver cabins D are high-floor portions 221*a* and 222*a*. A part of the passenger cabin P is positioned above the small-diameter wheels 9. The entire surface of the floor of the passenger cabin P is low-floor portions 221*c*, 222*c*, and 223*c* except for seats 221*d*, 222*d*, and 223*d*. The passenger cabin P is provided with entrances 221*e* and 222*e* on the side walls of the car bodies 221 and 222 adjacent the driver cabins D. In other words, the entrances 221*e* and 222*e* are positioned above the small-diameter wheels 9.

An intermediate car body 223 is provided with seats 223*d* at right and left sides such that an aisle which is the low-floor portion 223*c* is interposed between the seats 223*d*. The seats 223*d* extend in the driving direction and are arranged to face each other. The high-floor portion 223*e* is provided under the seats 223*d*. Under the high-floor portion 223*e*, axle boxes 251 are provided via bolster springs 252, respectively. Independent wheels 250 are rotatably mounted to the axle boxes 251, respectively.

In accordance with the above configuration, as in example 1, the large-diameter wheels 7 of the bogie 1 are positioned at the end portions of the car bodies 221 and 222 in the driving direction, and the small-diameter wheels 9 of the bogie 1 are positioned closer to the centers of the car bodies 221 and 222 in the driving direction, the large-diameter wheels 7 can maintain driving stability and the low-floor portions 221*c*, 222*c* and 223*c* can be extended to a region above small-diameter wheels 9 in the boarding space other than the driver cabins D.

Although in the above described embodiments, a light rail vehicle (LRV) driving on the railway track installed on a road has been described, the present invention is not limited to this but is applicable to other railway vehicles.

The invention claimed is:

1. A low-floor railway vehicle bogie comprising:

a bogie frame configured to support a car body of a railway vehicle through air springs, the car body having a space including, a passenger cabin and a driver cabin;

a main axle and a sub-axle which are disposed at front and rear sides of the bogie frame in a driving direction, respectively such that the main axle and the sub-axle extend in a rightward and leftward direction;

wheels attached to right and left sides of each of the main axle and the sub-axle;

axle boxes which are respectively mounted to right and left sides of each of the main axle and the sub-axle and are configured to support the main axle and the sub-axle; and axle box suspensions which are configured to elastically couple the axle boxes to the bogie frame to support the axle boxes, respectively; wherein the wheels attached to the main axle are large-diameter wheels and the wheels attached to the sub-axle are small-diameter wheels which have a smaller outer diameter than the large-diameter wheels;

wherein an upper end of each of the small-diameter wheels is set lower than a rotational center of each of the large-diameter wheels; and wherein the small-diameter wheels are positioned under the passenger cabin, and the large-diameter wheels and the air springs are positioned under the driver cabin.

2. The low-floor railway vehicle bogie according to claim 1, wherein each of the axle box suspensions includes an elastic body configured to elastically couple the axle box to the bogie frame; and wherein the elastic body has a nonlinear spring constant and is configured such that the spring constant increases as a displacement amount of the axle box with respect to the bogie frame increases.

3. The low-floor railway vehicle bogie according to claim 1, wherein each of the axle box suspensions includes a support member which is coupled to the bogie frame such that the support member is vertically pivotable with respect to the bogie frame and is configured to support the axle box with one side of a pivot axis of the support member, and an elastic body configured to apply an upward force to a portion of the support member which is at an opposite side of the pivot axis;

wherein the small-diameter wheel supported by each of the axle boxes is subjected to a downward force applied by the elastic body.

4. The low-floor railway vehicle bogie according to claim 1, wherein the bogie frame includes a first frame member for supporting the main axle and a second frame member which is coupled to the first frame member and is provided with the axle box suspensions;

and wherein the second frame member is coupled to the first frame member and is rotatable in a roll direction such that the second frame member rotates with respect to the first frame member around a rotational axis which is the driving direction.

5. The low-floor railway vehicle bogie according to claim 1, wherein the main axle is supported by the axle box suspensions via the axle boxes in a position which is outward relative to the pair of large-diameter wheels in the rightward and leftward direction;

and wherein the sub-axle is supported by the axle box suspensions via the axle boxes in a position which is inward relative to the pair of small-diameter wheels in the rightward and leftward direction.

6. The low-floor railway vehicle bogie according to claim 1, wherein the small-diameter wheels are rotatably attached to the sub-axle via bearings.

7. The low-floor railway vehicle bogie according to claim 1, wherein a guard plate is mounted to a front end portion of the bogie frame in the driving direction such that the guard plate extends vertically;

and wherein the guard plate is configured to cover a front end portion of the bogie frame to side end portions of the bogie frame.

8. The low-floor railway vehicle bogie according to claim 1, further comprising:

a bogie bolster disposed above the bogie frame; and a connecting device for connecting the bogie frame to the bogie bolster such that the bogie bolster is horizontally rotatable with respect to the bogie frame;

wherein a distance in the driving direction between a rotational center of the connecting device and a rotational center of each of the large-diameter wheels is smaller than a distance in the driving direction between the rotational center, of the connecting device and a rotational center of each of the small-diameter wheels.

9. A low-floor railway vehicle comprising:

a car body; and a bogie coupled to the car body through air springs, the bogie including:

a bogie frame;

a main axle extending in a rightward and leftward direction and positioned closer to an end portion of the car body in a driving direction;

a sub-axle extending in the rightward and leftward direction and positioned closer to a center of the car body than the main axle in the driving direction;

large-diameter wheels which are attached to right and left sides of the main axle;

small-diameter wheels which are attached to right and left sides of the sub-axle and have a smaller outer diameter than the large-diameter wheels;

axle boxes which are mounted to right and left sides of each of the main axle and the sub-axle and are configured to support the main axle and the sub-axle; and axle box suspensions which are configured to elastically couple the axle boxes to the bogie frame to support the axle boxes, respectively; wherein the car body includes:

a driver cabin which is positioned closer to the end portion of the car body in the driving direction and above the large-diameter wheels and the air springs; and a passenger cabin which is positioned closer to the center of the car body than the driver cabin and above the small-diameter wheels, the passenger cabin having a floor surface lower than a floor surface of the driver cabin, wherein an upper end of each of the small-diameter wheels is set lower than a rotational center of each of the large-diameter wheels.

* * * * *